US007663544B2

(12) United States Patent
Thomas et al.

(10) Patent No.: US 7,663,544 B2
(45) Date of Patent: Feb. 16, 2010

(54) ANTENNA SYSTEM FOR SHARING OF OPERATION

(75) Inventors: Louis David Thomas, Hampshire (GB); Philip Edward Haskell, Hampshire (GB)

(73) Assignee: Quintel Technology Limited, Bristol (GB)

( * ) Notice: Subject to any disclaimer, the term of this patent is extended or adjusted under 35 U.S.C. 154(b) by 223 days.

(21) Appl. No.: 11/917,814

(22) PCT Filed: Jun. 19, 2006

(86) PCT No.: PCT/GB2006/002223

§ 371 (c)(1),
(2), (4) Date: Dec. 17, 2007

(87) PCT Pub. No.: WO2006/136793

PCT Pub. Date: Dec. 28, 2006

(65) Prior Publication Data

US 2008/0204318 A1 Aug. 28, 2008

(30) Foreign Application Priority Data

Jun. 23, 2005 (GB) ..... 0512805.3

(51) Int. Cl.
*H01Q 21/06* (2006.01)
*H01Q 13/00* (2006.01)

(52) U.S. Cl. ..... 342/361; 343/781 CA

(58) Field of Classification Search ..... 342/361; 343/781 CA

See application file for complete search history.

(56) References Cited

U.S. PATENT DOCUMENTS

| | | | | |
|---|---|---|---|---|
| 5,229,729 | A | 7/1993 | Nishikawa et al. | |
| 5,451,969 | A * | 9/1995 | Toth et al. | 343/781 CA |
| 5,584,058 | A | 12/1996 | Arnold | |
| 6,067,053 | A | 5/2000 | Runyon et al. | |
| 6,300,900 | B1 | 10/2001 | Bleret | |
| 2004/0137947 | A1 | 7/2004 | Nimmo-Smith | |

FOREIGN PATENT DOCUMENTS

| | | |
|---|---|---|
| EP | 0416264 | 3/1991 |

(Continued)

*Primary Examiner*—Thomas H Tarcza
*Assistant Examiner*—Harry Liu

(57) ABSTRACT

An antenna system for sharing of operation employs contiguous transmit frequencies. Transmit frequencies are separated into non-contiguous sub-groups isolated from one another by filters 158(+) and 160(−) associated with positive and negative polarization. Received frequencies are filtered and split into five signals for input to base station receive ports. Non-contiguous transmit frequency sub-groups are combined by a quadrature hybrid 110 and pass with 90 degree relative phase shift to mutually orthogonal antenna stack ports P(+) and P(−) associated with orthogonally polarized sets of antenna elements AS(+) and AS(−): the ports P(+) and P(−) are isolated from one another by the hybrid 110. The 90 degree phase shift results in one transmit subgroup being radiated with left hand circular polarization and the other transmit subgroup being radiated with right hand circular polarization. Changing the relative phase shift changes the radiated polarization to linear or elliptical, and signal amplitude weighting provides control of antenna beam polarization direction.

30 Claims, 8 Drawing Sheets

FOREIGN PATENT DOCUMENTS

| | | |
|---|---|---|
| WO | WO 98/27614 | 6/1998 |
| WO | WO 98/47235 | 10/1998 |
| WO | WO 00/49677 | 8/2000 |
| WO | WO 02/082581 | 10/2002 |
| WO | WO 03/036756 | 5/2003 |
| WO | WO 03/043127 | 5/2003 |
| WO | WO 2004/088790 | 10/2004 |
| WO | WO 2004/102739 | 11/2004 |
| WO | WO 2005/018043 | 2/2005 |
| WO | WO 2005/048401 | 5/2005 |

* cited by examiner

ANTENNA SYSTEM FOR SHARING OF OPERATION

BACKGROUND OF THE INVENTION (1) Field of the Invention

This invention relates to an antenna system for sharing of operation by a number of operators, and, more particularly but not exclusively, to such a system for use in cellular mobile radio systems. The antenna system of the invention is intended for use in many phased array applications such as radar and telecommunications, but finds particular application in cellular mobile radio networks, commonly referred to as mobile telephone networks. Such networks include the second generation (2G) mobile telephone networks such as the GSM, CDMA (IS95), D-AMPS (IS136) and PCS systems, and third generation (3G) mobile telephone networks such as the Universal Mobile Telephone System (UMTS), and other cellular radio systems.

(2) Description of the Art

Operators of conventional cellular radio networks generally employ their own base stations each of which is connected to one or more antennas. Because the numbers of cellular radio networks and operators are increasing worldwide, both the number of antenna sites and the number of antennas per site is increasing. Legal authorities responsible for planning or zoning arrangements are concerned to minimise visual impact of antennas on the environment: they are increasingly imposing restrictions such as limits on numbers of antenna sites and obtrusiveness of antenna structures. Antenna sharing has potential for alleviating the problem of limiting site and antenna numbers. However, it introduces problems of RF signal power losses in signal combining, and reduced flexibility as regards signal polarisation options.

RF signal power losses in signal combining occur as follows: in transmit mode, it is important to avoid mixing of different transmit frequencies, because this gives rise to unwanted intermodulation products. To avoid this, it is known to use 3 dB combiners to combine signals while providing isolation between pre-combined signals. U.S. Pat. Nos. 5,229,729 and 5,584,058 disclose combining signals using one or more 3 dB combiners each with one port terminated in a resistive load. Resistive loads have the function of dissipating RF power which cannot usefully be employed, and must be disposed of to avoid undesirable effects on required signals; each 3 dB combiner consequently introduces a 50% power loss.

An antenna system for shared operation by multiple operators of base stations is disclosed by European patent no. EP 0 566 603. This patent describes multiple base stations of different types (GSM, ETACS, TACS) connected to respective band-pass transmit filters and thence to a common transmit antenna. Signal polarisation, isolation and combining power loss are not addressed.

In order to improve transmission performance, it is known to use diversity, i.e. to receive and/or transmit two or more diverse signals. Diverse signals are processed either individually or in combination. There are three common types of diversity, a) frequency diversity, b) spatial diversity and c) polarisation diversity. In transmit mode, a mobile cellular radio handset has a single antenna which transmits a carrier wave with a single polarisation. A base station uses a dual polarisation antenna with one antenna element (or set of elements) having a +45 degree polarisation and the other −45 degree polarisation. A signal from the handset therefore gives rise to two signals at the base station antenna. The base station processes both received signals and obtains an improved signal. This approach combats changes in the polarisation of radio signals due to different orientations of the handset's antenna and reflection at buildings etc., which cause signals to be received at a base station antenna with multiple polarisations.

Published International Application No. WO 02/0082581 discloses a technique for combining a set of signals in which pairs of signals which are adjacent in frequency have contiguous frequencies. This technique both provides pre-combined signal isolation and avoids incurring signal power loss in 3 dB combiners mentioned above. Treating signals in the set as being numbered sequentially in order of frequency, the WO 02/0082581 technique groups the signals into odd and even numbered sub-groups of non-contiguous frequencies in each case. The odd numbered sub-group is connected to antenna elements of one polarisation in an antenna system, and the even numbered sub-group is connected to antenna elements of an orthogonal polarisation in this antenna system. Signals in the two sub-groups become combined in transmit mode when radiated from the antenna. Combining in this way is referred to as air combining, because transmit signals are not combined within the antenna system but upon radiation from it into air.

The technique disclosed in WO 02/0082581 is appropriate for slant polarisation antennas, such as +45 degrees and −45 degrees relative to the vertical: it can however be desirable to have capability for implementing both vertical and circular polarisation which can improve communications performance. The WO 02/0082581 technique is also appropriate for transmit and received signals having the same polarisation. Slant polarisation is known to improve communications performance in the case of received signals, but it is not an optimum polarisation for transmit signals. This is because a receive antenna in a mobile telephone handset may become oriented orthogonally to a slant polarised transmit signal or nearly or effectively so (having regard to signal reflections), which results in partial or even complete loss of received signal at the handset.

SUMMARY OF THE INVENTION

It is an object of the present invention to provide an alternative form of antenna system for sharing of operation.

The present invention provides an antenna system for sharing of operation having:

a) means for dividing a set of transmit signals having contiguous frequencies into signal sub-groups having non-contiguous frequencies,
b) at least two antennas for radiating transmit signals in respective sub-groups, the antennas also being responsive to received signals and having mutually orthogonal ports,
c) coupling means for producing combined signals comprising at least one of combined transmit signals and combined received signals, the coupling means being arranged to:
   i) provide isolation between pre-combined signals, and
   ii) prearrange polarisation for combined signals by introduction of relative delay between signals associated with different antennas.

The invention provides the advantage that multiple users or operators of a shared antenna system are not restricted to a polarisation or polarisations prescribed by antenna geometry. Instead, either one of or optionally both of transmit signals and received signals may have prearranged polarisation which is programmed by choice of relative delay, and the polarisation in either case may be different to that associated with antenna geometry. The prearranged polarisation may be linear, circular or elliptical. In the case of transmit signals, prearranged polarisation means polarisation of signals radiated from the antennas. In the case of received signals, prearranged polarisation means signal polarisation corresponding to maximum sensitivity of signal reception by the antennas. a further benefit of the invention is that it is a possible retrofit to an existing antenna system at relatively modest cost.

The at least two antennas may each have multiple antenna elements, e.g. dipoles or patches, to provide capability for phased array operation. The coupling means may be a quadrature hybrid. It may be arranged to route each transmit signal sub-group to all antennas so that such sub-group becomes radiated from different antennas with relative delay. It may be arranged to weight signals differently in amplitude, and may use three amplitude weighting factors. Amplitude weighting of signals provides control of orientation of polarisation for antennas which are two-dimensional arrays of antenna elements, and both control of orientation of polarisation and control of antenna beam direction for antennas which are three dimensional arrays of antenna elements.

The at least two antennas may be three antennas and the coupling means may be a hybrid coupling means arranged to combine signals with a plurality of relative delays.

The at least two antennas may be incorporated in an antenna assembly mounted at a mast head with the coupling means, which itself is located either within or externally of the antenna assembly. The coupling means may alternatively be co-located with or located near a transmit signal sub-group combiner associated with a base station. It may be a 180 degree hybrid.

In an alternative aspect, the present invention provides a method for sharing of operation of an antenna system between multiple operators using a set of transmit signals having contiguous frequencies, the method having the steps of:

a) dividing the set of transmit signals into signal sub-groups having non-contiguous frequencies,
b) providing at least two antennas for radiating transmit signals in respective sub-groups, the antennas also being responsive to received signals and having mutually orthogonal ports,
c) producing combined signals comprising at least one of combined transmit signals and combined received signals,
d) providing isolation between pre-combined signals, and
e) introducing relative delay between signals associated with different antennas in order to prearrange polarisation for combined signals.

The method provides a like advantage to that of the antenna system aspect of the invention.

The steps of providing isolation and introducing relative delay may be applied to either one of or optionally both of antenna transmit signals and antenna received signals in order to prearrange either or both polarisation for signal transmission from the antennas and polarisation corresponding to maximum sensitivity of signal reception by the antennas.

The method may include the step of supplying each transmit signal sub-group to all antennas so that such sub-group becomes radiated from different antennas with relative delay.

The steps of producing combined signals providing isolation and introducing relative delay may be implemented using coupling means comprising a quadrature hybrid, and the prearranged polarisation may be circular or elliptical signal polarisation.

The at least two antennas may be three antennas and the step of introducing relative delay may introduces a plurality of relative delays. Each antenna may have multiple antenna elements. The method may include the step of weighting signals differently in amplitude in order to obtain prearranged polarisation directionality different to that corresponding to signals with like amplitude weighting. This step may employ three amplitude weighting factors.

The steps of producing combined signals providing isolation and introducing relative delay may be implemented using coupling means located within an antenna assembly containing the at least two antennas.

The at least two antennas may be incorporated in an antenna assembly mounted at a mast head and the steps of producing combined signals providing isolation and introducing relative delay may be implemented using coupling means located externally of the antenna assembly. The coupling means may alternatively co-located with or located near a transmit signal sub-group combiner associated with a base station. It may be a 180 degree hybrid.

DESCRIPTION OF THE FIGURES

In order that the invention might be more fully understood, embodiments thereof will now be described, by way of example only, with reference to the accompanying drawings, in which.

DESCRIPTION OF A PREFERRED EMBODIMENT

Figure 1:
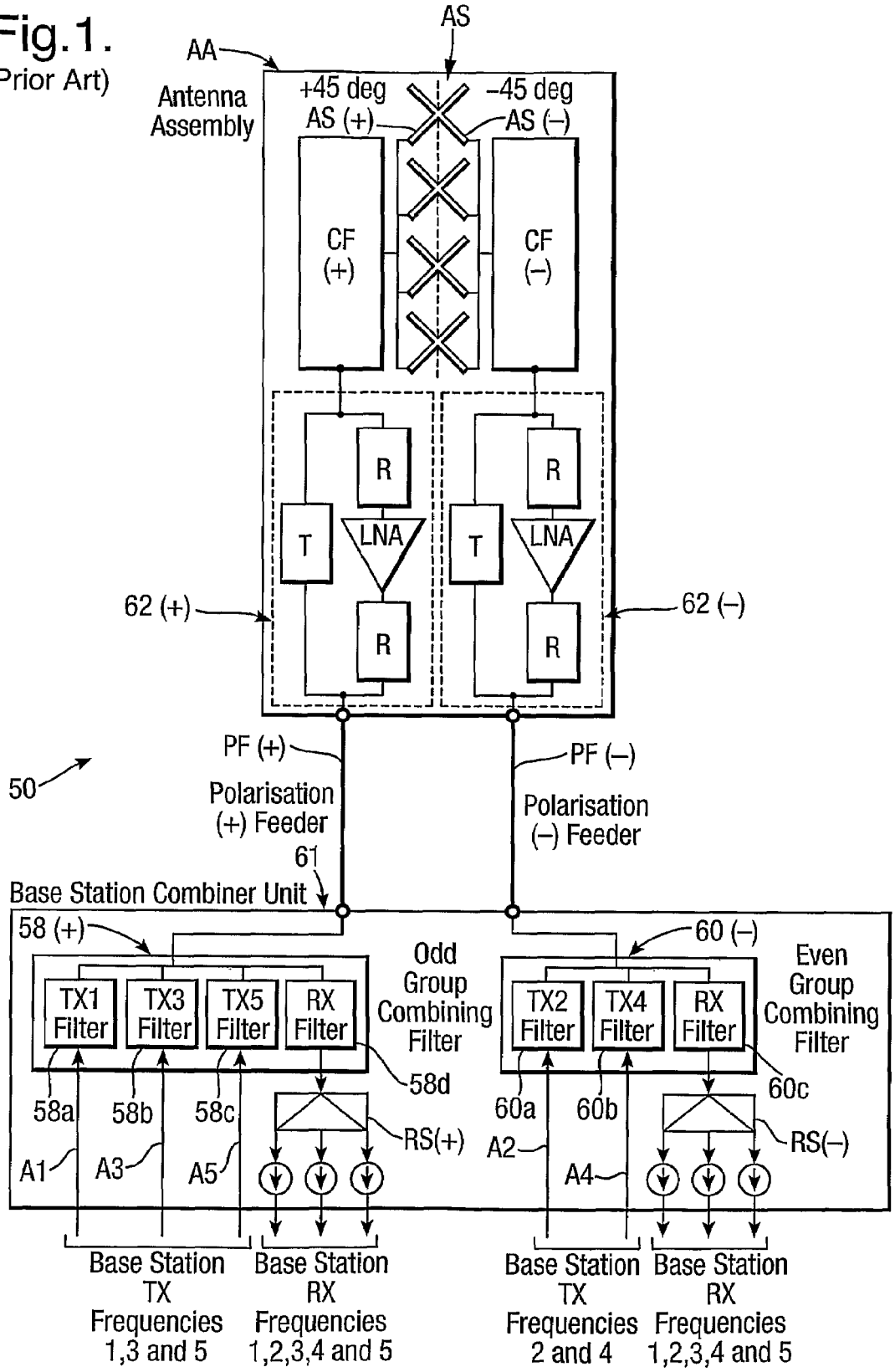
Fig.1. (Prior Art)
FIG. 1 is a schematic drawing of a prior art shared antenna system.

FIG. 1 shows a prior art antenna system of the kind to which WO 02/0082581 relates: it is indicated generally by 50, and it is intended for a base station having five transmit (TX) ports and five receive (RX) ports (not shown). The base station employs a first set of five contiguous transmit frequencies numbered 1 to 5 in order of ascending frequency and a second set of five contiguous receive frequencies numbered likewise. Because the transmit frequencies are contiguous, they cannot be separated by conventional filters which have finite frequency cut-off characteristics such that a filter for one frequency deleteriously affects a signal with an immediately adjacent frequency.

The sets of transmit and receive frequencies are in different frequency bands but are both associated with the same cellular radio system. The base station generates transmit signals which are subsequently radiated from positive (+45 degree) and negative (−45 degree) polarisations of an antenna stack AS in an antenna assembly AA. In the drawing (+) and (−) appear upon corporate antenna signal feeds CF(+) and CF(−)

and polarisation feeders PF(+) and PF(−): this indicates association with transmit signals intended to be radiated from the antenna stack AS with positive and negative polarisations respectively, and also association with received signals received at the antenna stack AS with such polarisations. Strictly speaking the expression "polarisation" is not very meaningful when applied to signals within the antenna system 50, but it is convenient to refer to signals and apparatus elements in terms of the polarisations they are associated with and corresponding to polarisations of signals transmitted from and received by the antenna stack AS.

Transmit signals are separated into odd numbered frequency sub-groups of signals 1, 3 and 5 and even numbered frequency sub-groups of signals 2 and 4. This has the effect that signals in each sub-group are not contiguous: in consequence, signals in each sub-group can be combined and later separated using conventional filters lacking infinite frequency cut-on and cut-off characteristics, and filtering applied to one signal in a sub-group does not significantly affect another in that sub-group.

Received signals do not require separation into odd and even numbered frequency sub-groups. They are of very much lower power than transmit signals, and base station receivers have an adjacent channel rejection capability that allows them to operate in a contiguous frequency environment.

Transmit signals designated TX1, TX3 and TX5 with odd numbered frequencies are fed as indicated by arrows A1, A3 and A5 from respective base station ports to a first filter bank 58(+) associated with positive polarisation and having three band pass transmit filters 58*a*, 58*b* and 58*c* and a single band pass receive filter 58*d*. Output signals at all five receive frequencies from the receive filter 58*d* are split into five signals (only three indicated for convenience) by a receive splitter RS(+) associated with positive polarisation, and the spilt signals pass to respective base station receive ports.

Transmit signals designated TX2 and TX4 with even numbered frequencies are fed as indicated by arrows A2 and A4 from respective base station transmit ports to a second filter bank 60(−) associated with negative polarisation, and having two band pass transmit filters 60*a* and 60*b* and a single band pass receive filter 60*c*. Output signals at all five receive frequencies from the receive filter 60*c* are split into five signals (only three indicated) by a receive splitter RS(−) associated with negative polarisation, and the spilt signals pass to respective base station receive ports. The first and second filter banks 58(+) and 60(−) and the receive splitters RS(+) and RS(−) collectively form a base station combiner unit 61.

The transmit signals TX1, TX3 and TX5 associated with positive polarisation are filtered by the band pass filters 58*a* to 58*c* having pass bands centred on transmit frequencies numbered 1, 3 and 5 respectively. Outside their frequency pass bands, the filters 58*a* to 58*c* provide signal attenuation which isolates the base station transmit ports from one another. This isolation avoids the generation of unwanted frequency intermodulation products arising from a signal of one frequency propagating into circuitry associated with a different transmit frequency in another base station port.

After filtering, transmit signals TX1, TX3 and TX5 are combined on the positive polarisation feeder PF(+), so the filters 58*a* to 58*c* act as combining filters. Similarly, the transmit signals TX2 and TX4 associated with negative polarisation are fed to the second filter bank 60(−) and are filtered by respective filters 60*a* and 60*b* providing base station transmit port isolation. After filtering transmit signals TX2 and TX4 are combined on the negative polarisation feeder PF(−).

The positive and negative polarisation feeders PF(+) and PF(−) are connected to positive and negative polarisation TX/RX filter assemblies 62(+) and 62(−) (within dotted lines), which are in turn connected to respective input ports (not shown) of the corporate antenna signal feeds CF(+) and CF(−) respectively. The filter assemblies 62(+) and 62(−) have transmit band pass filters indicated by T which respectively transmit the odd-numbered transmit signal sub-group TX1, TX3 and TX5 associated with positive polarisation and the even numbered transmit signal sub-group TX2 and TX4 associated with negative polarisation. These signal sub-groups pass to the corporate antenna signal feeds CF(+) and CF(−) and thence to the antenna stack's positive and negative polarisation antenna elements such as AS(+) and AS(−) for radiation to free space. The positive and negative polarisation elements such as AS(+) and AS(−) are polarised orthogonally to one another, and consequently radiation from positive polarisation elements cannot be received by negative polarisation elements and vice versa.

The filter assemblies 62(+) and 62(−) also have pairs of receive band pass filters indicated by R and low noise amplifiers LNA therebetween protected against overload from transmit signals by the filters T and R: the receive band pass filters R each transmit all five received signal frequencies. The five received signal frequencies pass via the polarisation feeders PF(+) and PF(−) to receive filters 58*d* and 60*c* and thence to splitters RS(+) and RS(−) providing spilt signals to base station receive ports associated with positive and negative polarisation respectively.

As mentioned earlier, the prior art antenna system 50 suffers from the disadvantage of not having capability for vertical or circular polarisation, because both its transmit and received signals have slant polarisation. Slant polarisation is not optimum for transmit signals: this is because an antenna in a mobile telephone handset may be orientated orthogonally (or nearly so) to a slant polarised base station transmit signal, which results in loss of received signal at the handset and signal fading experienced by the handset's user.

Figure 2:
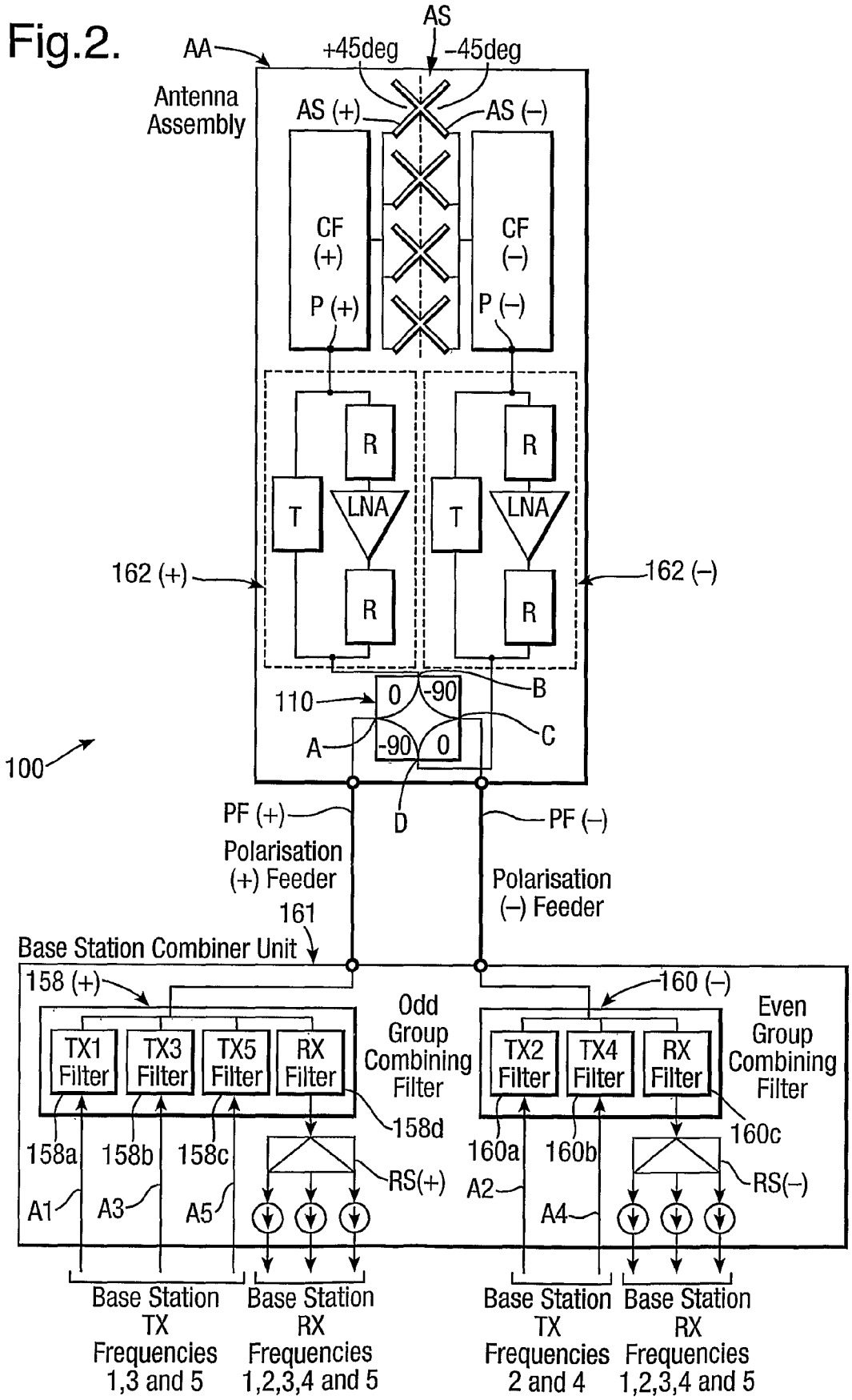
FIG. 2 is a schematic drawing of a shared antenna system of the invention providing circular polarisation for both transmit and receive modes.

FIG. 2 shows an antenna system of the invention indicated generally by 100. It is equivalent to the prior art antenna system 50 with a quadrature hybrid coupler (hybrid) 110 inserted in signal paths. Parts equivalent to those described with reference to FIG. 1 are like referenced with—in the case of numerical references only—a prefix 100. Elements in FIG. 2 other than the hybrid 110 are equivalent to and have the same mode of operation as like referenced elements of FIG. 1, and will not be described in detail. Description of FIG. 2 will be directed to aspects of difference compared to FIG. 1.

The antenna system 100 is shown with an antenna stack AS with +45 degree and −45 degree slant polarisation (i.e. orthogonally polarised) ports as in the prior art system 50, but this is not essential. As will be described later in more detail, the invention may be implemented with a variety of antenna types.

The hybrid 110 is a hybrid signal coupling device having four ports A, B, C and D. Port A and port C are each being coupled to ports B and D, but pairs of ports on mutually opposite sides of the hybrid are electrically isolated from one another: i.e. ports A and C are isolated from one another and so also are ports B and D.

The expression "hybrid" indicates a device that applies a prearranged, non-zero, phase shift to a signal passing between two of its ports. In this connection, expressions "−90" between ports A and D and between ports B and C indicate that a signal passing from port A to port D or from port B to port C experiences a phase shift of −90 degrees. This also applies to a signal passing in the reverse direction from port D to port A or from port C to port B, i.e. the −90 degree phase shift is bidirectional. Similarly, the expression "0"

between ports A and B indicate that a signal passing in either direction between these ports experiences a zero phase shift, and likewise for ports C and D. These phase shift values are relative, in that the hybrid 110 may impose a further phase shift, but if so it affects all signals equally and can be ignored.

Port A is connected to the positive polarization feeder PF(+) and port C is connected to the negative polarization feeder PF(−). Port B is connected to the positive polarization TX/RX filter assembly 162(+) and port D is connected to the negative filter assembly 162(−). The TX/RX filter assemblies 162(+) and 162(−) are in turn connected to the corporate antenna signal feeds CF(+) and CF(−) respectively and thence to the antenna stack AS.

The hybrid 110 may provide equal or unequal amplitude splitting of a signal input to port A or port C and divided between ports B and D. If unequal, the split may be $X^2$ % of the power through the 0 degree phase shift path (port A to port B or port C to port D), so that the power through the −90 degree path is $(1-X^2)$ % (port A to port D or port C to port B): this ignores losses due to non-ideal components. Similar considerations apply in reverse in receive mode.

The effect of the introduction of the hybrid 110 between the positive and negative polarisation feeders PF(+) and PF(−) and the positive and negative polarisation TX/RX filter assemblies 162(+) and 162(−) is as follows. The positive polarisation feeder PF(+) provides input of the odd numbered frequency sub-group of signals 1, 3 and 5 to port A, and the negative polarisation feeder PF(−) provides input of the even numbered frequency sub-group of signals 2 and 4 to port C. Both these inputs give rise to outputs at ports B and D: the odd numbered frequency sub-group appears with zero phase shift at port B and with −90 degrees phase shift at port D. The even numbered frequency sub-group appears with −90 degrees phase shift at port B and with zero phase shift at port D. Because of the isolation between ports A and C, input signals at each of these ports do not reach the other or the polarisation feeder PF(+) or PF(−) connected thereto and therefore cannot give rise to unwanted intermodulation products arising from signal mixing.

Since port B is connected to positive polarisation TX/RX filter assembly 162(+), this assembly receives input of the odd numbered frequency sub-group with zero phase shift and the even numbered frequency sub-group with −90 degrees phase shift. Similarly, the negative polarisation TX/RX filter assembly 62(−) connected to port D receives input of the odd numbered frequency sub-group with −90 degrees phase shift and the even numbered frequency sub-group with zero phase shift. These signal sub-groups pass to ports P(+) and P(−) of the corporate antenna signal feeds CF(+) and CF(−), and thence to the positive and negative polarisation antenna elements such as AS(+) and AS(−) respectively for radiation to free space. The positive and negative polarisation elements such as AS(+) and AS(−) are polarised orthogonally to one another, and therefore so also are the corporate antenna signal feed ports P(+) and P(−). Consequently radiation from positive polarisation elements cannot be received by negative polarisation elements and vice versa. Mixing of signals occurs in free space: the odd numbered frequency sub-group is radiated with zero phase shift from positive polarisation antenna elements such as AS(+) and with −90 degrees phase shift from negative polarisation antenna elements such as AS(−). Mixing in free space results in radiation of odd numbered frequencies with left hand circular polarisation.

The even numbered frequency sub-group is radiated with zero phase shift from negative polarisation antenna elements such as AS(−) and with −90 degrees phase shift from positive polarisation antenna elements such as AS(+). This corresponds to reversal of the phase shift with respect to the antenna element polarisations, and therefore mixing in free space results in radiation of even numbered frequencies with right hand circular polarisation (as opposed to left hand earlier). Circular polarisation is beneficial because it counteracts loss of signal due to polarisation mismatch between an antenna stack and a mobile telephone handset antenna.

As previously indicated, the hybrid 110 combines transmit signals passing to it from the positive and negative polarisation feeders PF(+) and PF(−) while isolating signals on different feeders from one another to avoid generation of signal intermodulation products.

It also combines received signals passing to it from the positive and negative polarisation TX/RX filter assemblies 162(+) and 162(−), while isolating from one another signals output from different assemblies. It therefore produces both combined transmit signals and combined received signals, and provides isolation between signals passing to it as inputs from feeders or filter assemblies. Transmit and received signals passing to the hybrid 110 for combining are referred to herein as "pre-combined" signals.

The systems 50 and 100 have antenna stacks AS each with antenna dipoles and orthogonal ports. Here a stack is a single line (often but not necessarily vertical) of antenna elements: at a number of (usually equally spaced) antenna element positions along the line, there may be one, two, or three antenna elements. If there are two or three antenna dipoles at a position along the line they are orientated so as to be orthogonal to one another, where "orthogonal" means that a transmit signal fed into one antenna element is not received to any significant extent by another such element located at the same point along the line. The expression "orthogonal ports" means that a transmit signal input to one antenna port does not give rise to any significant output from another port of that antenna. In receive mode, an antenna has orthogonal ports if there is a particular polarisation of received signal incident on the antenna which gives rise to zero output at one of the ports and non-zero output at another port.

If there are three antenna elements at each position along a line of antenna elements and each antenna element is a dipole, then they and associated antenna ports will be orthogonal to one another if the dipoles are crossed or orientated substantially at right angles to one other and their centres coincide: here the expression "substantially at right angles" would include elements disposed sufficiently closely to 90 degrees relative to one another that transmit signal coupling between them is negligible. Dipoles arranged to define Cartesian X, Y and Z co-ordinates would be orthogonal.

The hybrid 110 may be located:

a) within the antenna assembly AA at an antenna support mast head (not shown), or b) at the mast head but externally to the antenna assembly AA, or c) within the base station combiner unit 161 and connected to receive output signals from filters 158(+) and 160(−) and supply transmit signals to feeders PF(+) and PF(−).

Of these possible locations for hybrid 110, a) above requires that signal feeders (jumper cables) between the hybrid and the antenna assembly 100 provide appropriate signal phase relative to one another (e.g. phase matching) so as to preserve an intended antenna radiation pattern; c) requires that appropriate relative signal phase be provided in entire signal paths from the hybrid 110 to the antenna assembly AA. This is not a disadvantage in an antenna system which requires phase matched feeders for other purposes, as disclosed for example in WO 03/043127.

The antenna system 100 may be modified by changing the quadrature hybrid 110 to a 180 degree hybrid, also known as a sum-and-difference hybrid, in which case:

a) the antenna system so modified will radiate vertically polarised signals of one sub-group and horizontally polarised signals of the other sub-group, and b) if the antenna elements are rotated so that they are polarised vertically and horizontally, the antenna system will radiate +45 degree slant polarised signals of one sub-group and −45 degree slant polarisation signals of the other sub-group.

The antenna system 100 has been described in relation to transmit mode. In receive mode, received signals pass in the reverse direction from the antenna stack AS to the base station, and a radio wave incident from free space on the antenna stack AS will give rise to a maximum received signal when its polarisation matches that prearranged by means of the hybrid 110 for the antenna elements which receive it.

A quadrature hybrid with unequal power split may be used in the antenna system 100 in place of the quadrature hybrid 110, in which case it is possible to set independently both radiated polarisation type and polarisation orientation (direction of polarisation if linear or of ellipse axes if elliptical). If the power to one set of like polarised antenna elements e.g. AS(+) is reduced, while the power to the other such set e.g. AS(−) is increased, then radiated polarisation will remain linear but the polarisation angle will move back towards the orientation of the antenna element set with the higher power.

The antenna stack AS has two sets of multiple antenna elements which are dipoles, e.g. AS(+) and AS(−). It is convenient to have such multiple antenna elements because it enables operation using phased array principles: however, it is not essential. The invention may be implemented with two antennas each of which has only a single element such as a dipole or a patch.

The antenna system 100 implements grouping of contiguous frequencies into non-contiguous sub-groups: this is beneficial because it means the antenna system 100 allows sharing by operators using contiguous frequencies, a common feature of cellular mobile radio systems.

Figure 3:
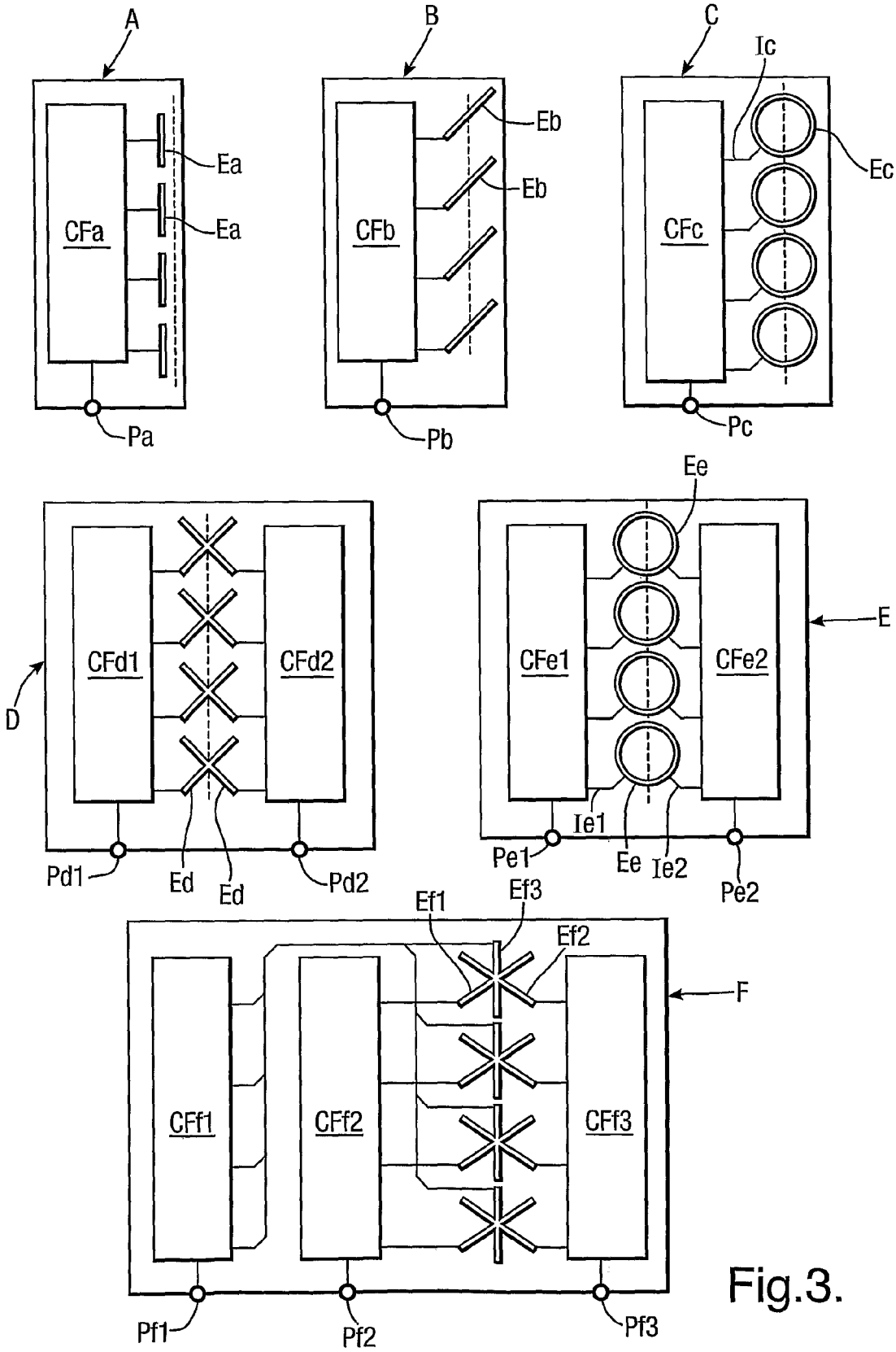
FIG. 3 shows single stack multi-port antennas suitable for use in implementing the invention.

Referring now to FIG. 3, there is shown a variety of antenna stacks A to F suitable for implementing the invention. Antenna stacks A and B are single stack, single port, antenna stacks having vertical and slant transmit polarisations respectively. Antenna stack A has a single signal port Pa connected to a corporate feed CFa for supplying antenna elements such as Ea with a signal with phase and amplitude appropriate for a required transmit beam shape. Similarly, antenna stack B has a single port Pb and corporate feed CFb for signal supply to antenna elements such as Eb which are slanted.

Antenna stack C is also a single stack, single port, antenna stack, but having selectable transmit polarisation. It has a single port Pc connected to a corporate feed CFb for supplying antenna elements such as Ec: these antenna elements are patches each with a single input or feed point such as Ic at lower left. The antenna stack C may provide either vertical, slant or circular polarisation, depending on the construction and positioning of patch feed points Ic etc. As illustrated, it provides 45 degree slant polarisation because a feed point at lower left of each patch produces a radiative standing wave on a patch diagonal extending from lower left to upper right.

Antenna stack D is a single stack, dual port, antenna having +45 degree and −45 degree transmit polarisation dipole antenna elements such as Ed connected to feeds CFd1 and CFd2 on left and right respectively. Signal ports Pd1 and Pd2 are connected to respective element polarisations via the feeds CFd1 and CFd2. The ports Pd1 and Pd2 are orthogonal in transmit mode in that a transmit signal entering port Pd1 will not emerge from port Pd2 to any significant extent. In practice these ports would be isolated from one another (port-to-port isolation) by 30 dB or more.

Antenna stack E is also a single stack, dual port, antenna having +45 degree and −45 degree transmit polarisation antenna elements, but in this case the antenna elements are patches such as Ee. It has signal ports Pe1 and Pe2 connected to respective antenna element polarisations via feeds CFe1 and CFe2. Antenna element or patch polarisations are implemented by the positioning of two feed points such as Ie1 and Ie2 connected to each patch at lower left and lower right respectively. As illustrated, it provides +45 degree and −45 degree slant transmit polarisation: this is because the lower left and lower right feed points Ie1 and Ie2 produce two standing electrical waves on patch diagonals extending orthogonally to one another from lower left to upper right and lower right to upper left respectively. The ports Pe1 and Pe2 are therefore mutually orthogonal. Patch feed points such as Ie1 and Ie2 may be positioned relative to patches Ee etc. to provide radiation from the antenna stack E with linear polarisation at any angle to the vertical, or alternatively circular or elliptical polarisation. This antenna stack may be substituted for the dipole antenna stack AS in the antenna system 100 described with reference to FIG. 2.

Antenna stack F is a single stack, triple port antenna having dipole antenna elements such as Ef1, Ef2 and Ef3 oriented respectively parallel to X, Y and Z Cartesian axes (shown pseudo-three dimensionally): here the X and Y axes lie in the horizontal plane and the Z axis in the vertical plane, so the antenna stack F provides two horizontally polarised transmit signals and one vertically polarised transmit signal and all these three transmit signals are mutually orthogonal. Signal ports, Pf1, Pf2 and Pf3 are connected to X, Y and Z dipole antenna polarisations via feeds CFe1, CFe2 and CFe3 respectively. The ports Pf1, Pf2 and Pf3 are mutually orthogonal for reasons previously given.

The ports Pd1/Pd2, Pe1/Pe2 and Pf1/Pf2/Pf3 shown in FIG. 3 will not normally be orthogonal in receive mode. They will only be orthogonal to a received signal if, fortuitously, that signal when incident on the respective antenna stack D, E or F has a polarisation coincident with that of a line of antenna elements receiving it. If this criterion is not satisfied, a received signal will emerge from both ports Pd1/Pd2 or Pe1/Pe2 or all three ports Pf1/Pf2/Pf3.

The antenna system 100 of the invention was described with an antenna stack AS of the form of antenna D, but may employ any of the antenna stacks A to F. It was also described in relation to transmit signals, but it applies equally to received signals which travel from the antenna stack AS to base station ports in the reverse direction compared to transmit signals.

Figure 4:
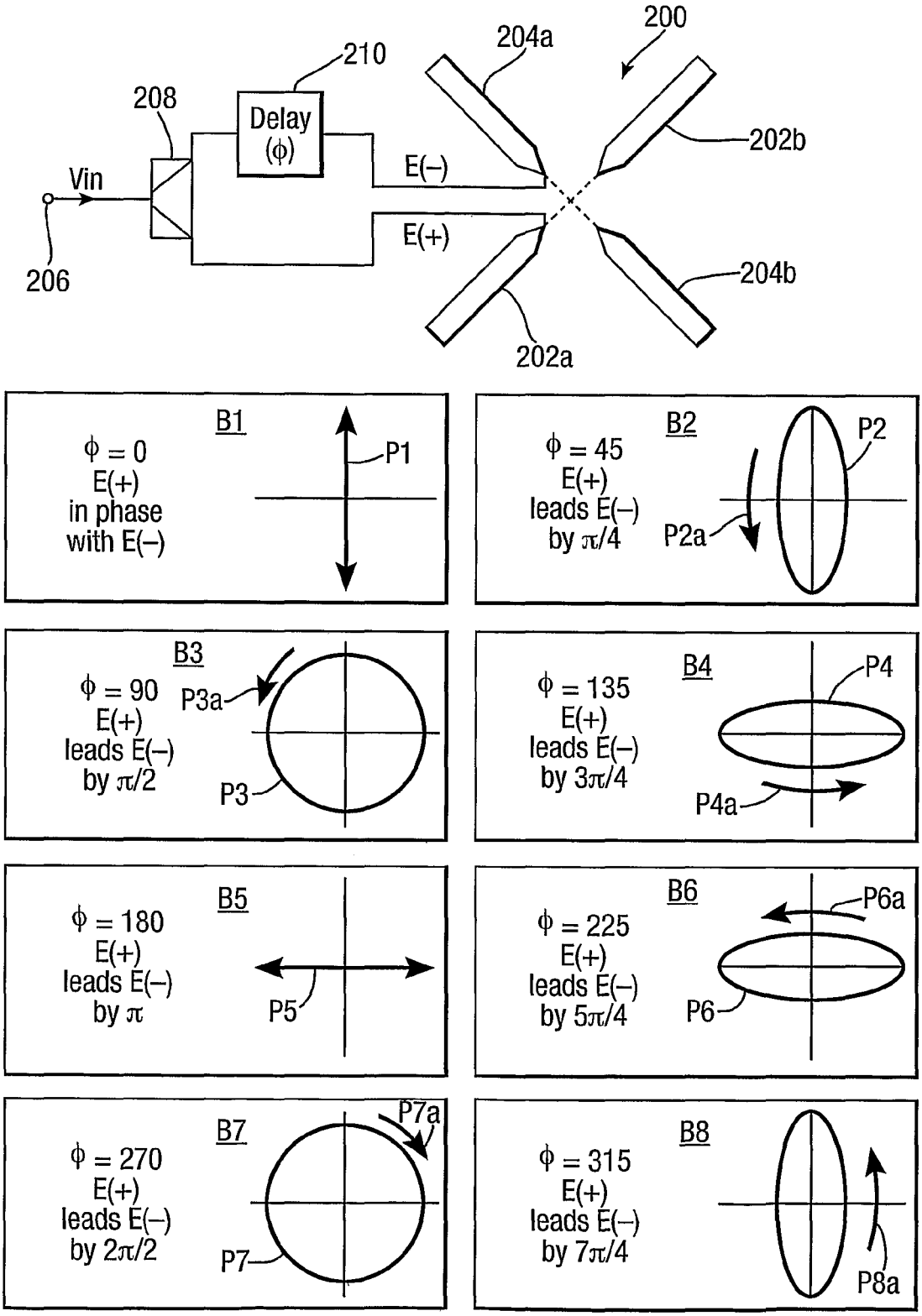
FIG. 4 shows transmit or receive polarisation options obtainable using the invention with equal amplitude signals of differing phase.

Referring now to FIG. 4, boxes B1 to B8 show eight different transmit signal polarisations P1 to P8 for an antenna 200 consisting of two mutually orthogonal crossed dipoles 202 and 204 with respective limbs 202*a*/202*b* and 204*a*/204*b*. The dipoles 202 and 204 receive the same signal but with a relative phase difference or delay $\phi$. An input 206 provides a signal Vin to a splitter 208, which splits the signal into two signals of equal amplitude and phase: one of the two split signals is then delayed by $\phi$ relative to the other in a phase shifter 210 to provide delayed and undelayed signals E(−) and E(+) to the dipoles 202 and 204 respectively.

Box 1 shows a signal with linear vertical polarisation P1 radiated from the antenna 200 when $\phi=0$ and signals E(−) and E(+) are therefore in phase with one another. In box 2, a signal with elliptical polarisation P2 with (as drawn) vertical major axis is obtained when $\phi$=45 degrees and signal E(+) therefore leads signal E(−) by $\pi/4$. P2 has left hand elliptical polarisation as indicated by an arrow P2*a*. The situation for $\phi$=90 degrees is shown in box 3, i.e. a radiated signal with left hand circular polarisation as indicated by an arrow P3*a*. That for $\phi$=135 degrees is shown in box 4, i.e. a radiated signal with left hand elliptical polarisation P4 and horizontal major axis as indicated by an arrow P4*a*. In box 5, a signal with linear horizontal polarisation P5 results when $\phi$=180. Boxes 6, 7 and 8 show the situations for $\phi$=225, 270 and 315 degrees, which are the mirror images of boxes 4, 3 and 2: i.e. they have the same elliptical or circular polarisations respectively, but the hand of the polarisation is reversed, it is right hand instead of left. As will be described later in more detail, it is possible to change the direction of linear polarisation or of the elliptical polarisation major axis by changing the relative amplitudes of signals E(−) and E(+) using amplitude weighting.

Figure 5:
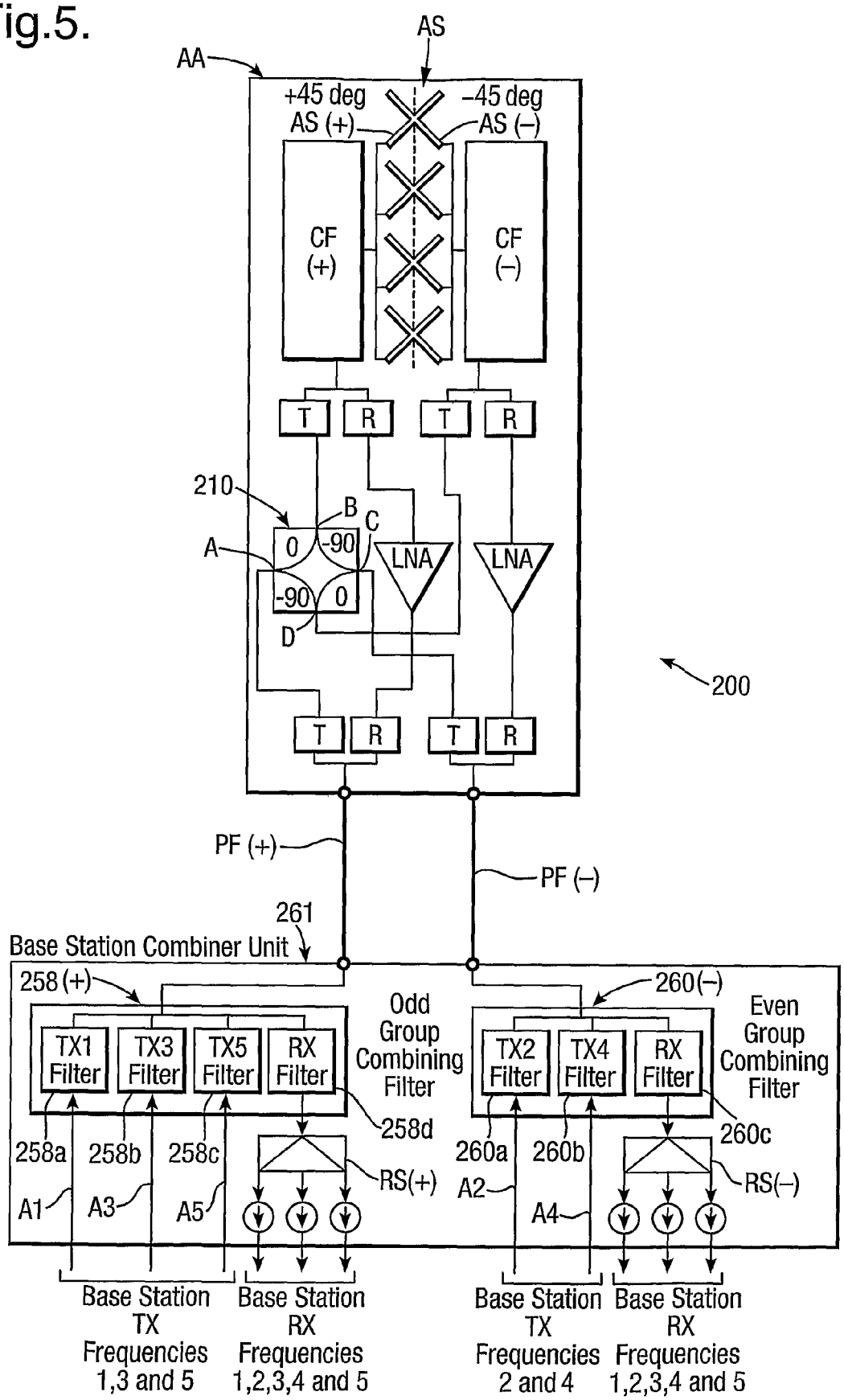
FIG. 5 is a schematic drawing of a second embodiment of the invention implementing circular polarisation for transmit signals and slant polarisation for received signals.

FIG. 5 shows a further embodiment of an antenna system of the invention indicated generally by 200. It provides circular polarisation for transmit signals and slant polarisation for received signals. It is equivalent to the earlier embodiment 100 described with reference to FIG. 2 with additional transmit filters T and changes to connections to a quadrature hybrid 210 inserted in transmit signal paths. Parts equivalent to those described with reference to FIG. 2 are like referenced with—in the case of numerical references only—a prefix 200 replacing 100. Elements in FIG. 5 which are equivalent to and have the same mode of operation as like referenced elements of FIG. 2 will not be described. Description of FIG. 5 will be directed to aspects of difference.

Ignoring the additional transmit filters T, the main change to the antenna system 200 compared to the earlier embodiment 100 is that received signals are now not connected to the hybrid 210, they bypass it. Transmit signals pass are however connected to the hybrid 210 and pass through it as before. Consequently transmit signals are radiated from the antenna stack AS with circular polarisation as previously described: however, received signals are incident on mutually orthogonally slant polarised antenna dipole elements such as AS1 and AS2, and their detection in the base station as vectors projected on to these elements is unaffected by the hybrid 210. Received signals are therefore received as orthogonal slant polarised signals.

Circular polarisation in transmit mode reduces the possibility of a null (zero amplitude received signal) occurring in down-link from a base station to a mobile handset due to differently oriented polarisations of an antenna stack and a mobile handset antenna. In an up-link direction, that is from a mobile handset to a base station, a base station antenna retains slant polarisation diversity for received signals and hence may select or combine these signals to improve up-link communications performance.

The antenna system 200 uses dual feeders PF(+) and PF(−). It may be converted to a four feeder equivalent by using separate feeders for transmit and received signals. This removes the need for two duplex filters in the antenna assembly AA, and it removes the receive filters 258*d* and 260*c* in the odd and even combining filter banks 258(+) and 260(−). It will prevent frequency intermodulation products (IPs) generated in the feeders from falling within a base station receive band causing de-sensitisation of a base station receiver.

It is possible to produce another variant of the embodiment 200 by exchanging transmit and received signal paths: i.e. in the variant, transmit signals bypass the hybrid 210 and received signals pass through it instead of vice versa. Consequently, the variant is preferentially sensitive to received signals with circular polarisation; transmit signals are radiated from mutually orthogonally slant polarised antenna dipole elements, and therefore become orthogonal slant polarised signals. Rearranging FIG. 5 to implement this is straightforward and will not be described.

The embodiment 100, FIGS. 3 and 4, the embodiment 200 and the variant referred to above demonstrate that the invention provides control over polarisation in one of or both of transmit and receive modes for a variety of antenna types. In particular, it is possible to use an antenna stack with orthogonal antenna elements giving e.g. +45 degree polarisation and −45 degree slant polarisation but with prearranged polarisation which is linear, elliptical or circular and in either of or both of transmit and receive modes. If linear, the prearranged polarisation may be vertical or otherwise differing from + or −45 degree slant polarisation.

Figure 6:
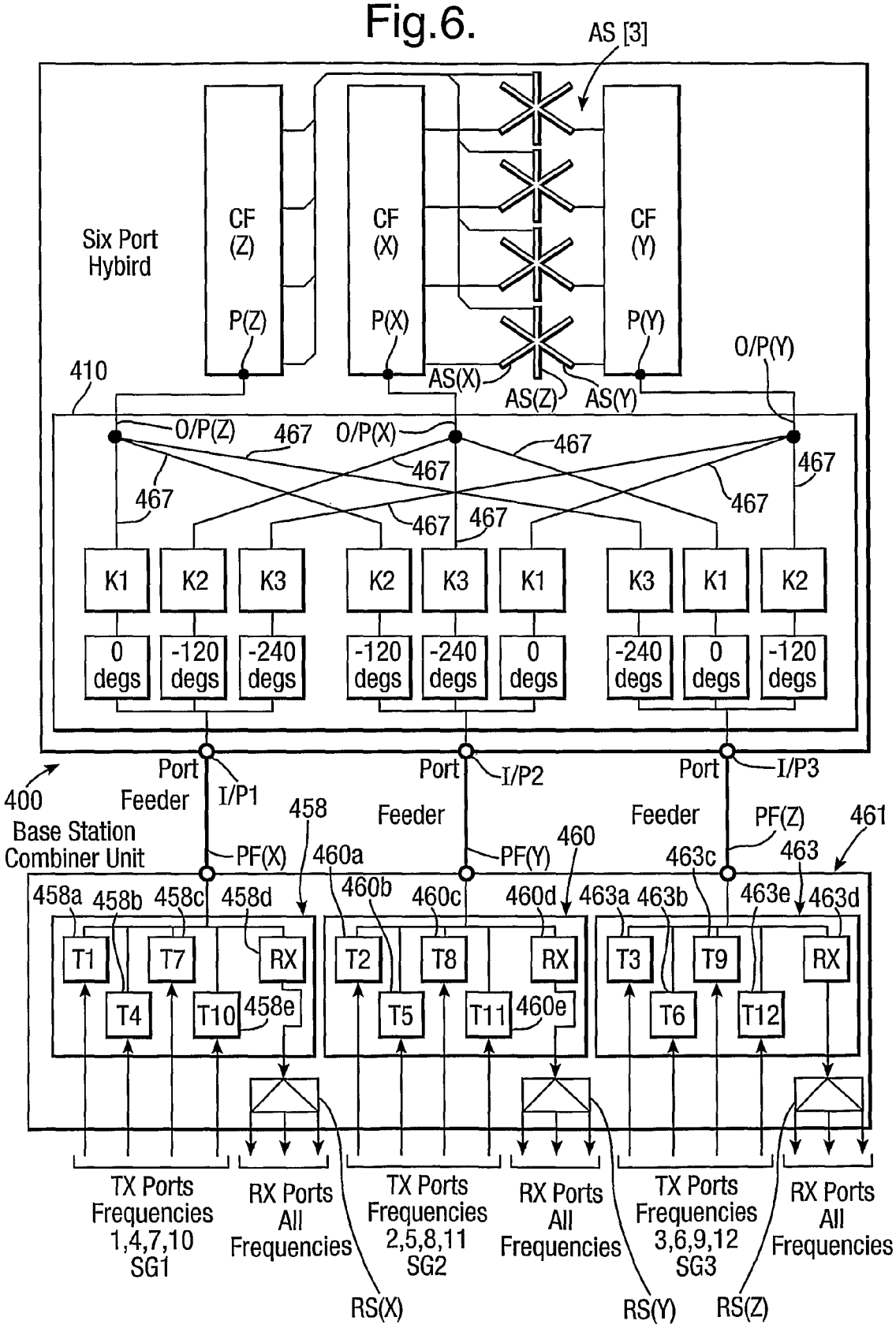
FIG. 6 is a schematic drawing of an embodiment of the invention with a three dimensional antenna assembly of orthogonal dipole antenna elements.

FIG. 6 shows a further embodiment of an antenna system of the invention indicated generally by 400. It is equivalent to the earlier embodiment 100 described with reference to FIG. 2 adapted for a respective set of twelve contiguous frequencies in each of transmit and receive modes using a three dimensional dipole antenna structure AS[3]. It has a six port hybrid coupler (six port hybrid) 410 inserted in transmit and received signal paths instead of a quadrature hybrid. Parts equivalent to those described with reference to FIG. 2 are like referenced with—in the case of numerical references only—a prefix 400 replacing 100. In addition, reference indicia suffixes "(X)", "(Y)" and "(Z)" represent horizontal, horizontal rotated 90 degrees relative to X and vertical polarisation respectively: these suffixes replace "(+)" and "(−)" which represented +45 and −45 degree slant polarisation in the earlier embodiment 100. Elements in FIG. 6 which are equivalent to and have the same or an equivalent mode of operation as like referenced elements of FIG. 2 will not be described in detail, and description of FIG. 6 will be directed to aspects of difference.

A base station combiner unit 461 receives a set of twelve contiguous transmit frequencies numbered 1 to 12 from respective base station transmit ports (not shown): these frequencies separated into three transmit subgroups SG1, SG2 and SG3, which are fed to different transmit/receive filter banks, i.e. filter banks 458, 460 and 463 respectively. Subgroup SG1 consists of transmit frequencies numbered 1, 4, 7 and 10, subgroup SG2 those numbered 2, 5, 8 and 11, and subgroup SG3 those numbered 3, 6, 9 and 12. Each of the subgroups SG1, SG2 and SG3 therefore consists of non-contiguous frequencies. Transmit filters are indicated by boxes labelled T1 to T12 with reference indicia 458 to 463 suffixed by a, b, c or e. Each transmit/receive filter bank 458, 460 or 463 also has a receive filter 458*d*, 460*d* or 463*d* that accepts all twelve receive frequencies in the set of carriers 1 to 12. Alternatively, separate receive filters may be used for individual receive frequencies in order to reduce noise levels presented to inputs of base station receivers. Receive splitters RS(X), RS(Y) and RS(Z) in respective filter banks 458, 460 and 463 split received signals into twelve (three splits are indicated in the drawing) and relay the split signals to base station ports (not shown) for filtering into individual receive frequencies.

For convenience of illustration, details of the construction of the six port hybrid 410 are not shown: instead signal paths within this hybrid are labelled with applied phase shifts and signal amplitude weightings which are experienced by signals in those paths: i.e. boxes inscribed "0 degs", "−120 degs" and "−240 degs" represent applied phase shifts of 0, −120 degrees and −240 degrees respectively, and boxes inscribed "K1", "K2" and "K3" represent signal amplitude weighting factors K1, K2 and K3 respectively, where:

$K1^2+K2^2+K3^2=1$, ignoring power losses due to departure of the properties of the six port hybrid 410 from ideal properties.

If K1, K2 and K3 are selected to be equal, then each is $3^{-1/2}$. They are implemented by signal splitting.

Filtered transmit signal sub-groups SG1, SG2 and SG3 from the transmit/receive filter banks 458, 460 and 463 are connected by feeders PF(X), PF(Y) and PF(Z) to first, second and third hybrid inputs I/P1, I/P2 and I/P3. These sub-groups are each amplitude-split into three after reaching the inputs I/P1, I/P2 and I/P3, and all undergo phase shifts of 0, −120 degrees and −240 degrees and become amplitude weighted by K1, K2 and K3. The six port hybrid 410 has first, second and third outputs O/P(X), O/P(Y) and O/P(Z) connected to first, second and third corporate feeds CF(X), CF(Y) and CF(Z) respectively.

The six port hybrid outputs O/P(X), O/P(Y) and O/P(Z) are cross connected by links 467 to receive multiple phase shifted and amplitude weighted transmit signals: the first output O/P (X) is centrally located and receives the first transmit signal sub-group SG1 phase shifted by −120 degrees and weighted by K2; it receives the second transmit signal sub-group SG2 phase shifted by −240 degrees and weighted by K3, and the third transmit signal sub-group SG2 with zero phase shift and weighted by K1. The second output O/P(Y) is located on the right and receives the first transmit signal sub-group SG1 phase shifted by −240 degrees and weighted by K3; it receives the second transmit signal sub-group SG2 with zero phase shift and weighted by K1, and the third transmit signal sub-group SG2 phase shifted by −120 degrees and weighted by K2. The third output O/P(Z) is located on the left and receives the first transmit signal sub-group SG1 with zero phase shift and weighted by K1; it receives the second transmit signal sub-group SG2 phase shifted by −120 degrees and weighted by K2, and the third transmit signal sub-group SG2 −240 degrees and weighted by K3.

As has been said, the outputs O/P(X), O/P(Y) and O/P(Z) are connected to ports P(X), P(Y) and P(Z) of corporate feeds CF(X), CF(Y) and CF(Z) respectively, which are in turn connected to the three dimensional dipole antenna structure AS[3]: this structure is a vertical array of sets of three crossed dipoles, and each set has a respective first dipole such as AS(X) polarised horizontally, a respective second dipole such as AS(Y) polarised horizontally and rotated 90 degrees relative to AS(X), and a respective third dipole such as AS(Z) polarised vertically. Here "crossed" means the three dipoles have their dipole centres at a common point in space.

The first corporate feed CF(X) is connected to the horizontally polarised first dipole of each of the dipole sets e.g. AS(X), the second corporate feed CF(Y) is connected to the rotated horizontally polarised second dipole of each set, e.g. AS(Y), and the third corporate feed CF(Z) is connected to the vertically polarised third dipole of each set, e.g. AS(Z). The sets of three crossed dipoles such as AS(X), AS(Y) and AS(Z) are mutually orthogonally polarised, and consequently so also are the ports P(X), P(Y) and P(Z) of the corporate feeds CF(X), CF(Y) and CF(Z).

TABLE 1

| Transmit Frequency | Transmit Frequency | Relative Excitation Phase | | |
|---|---|---|---|---|
| Sub-Group | Number | Dipole (X) | Dipole (Y) | Dipole (Z) |
| SG1 | 1, 4, 7, 10 | 0 degs | −120 degs | −240 degs |
| SG2 | 2, 5, 8, 10 | −120 degs | −240 degs | 0 degs |
| SG3 | 3, 6, 9, 12 | −240 degs | 0 degs | −120 degs |

Table 1 above shows the frequency numbers and phases of transmit signals received by the dipoles in each set referred to as Dipole (X), Dipole (Y) and Dipole (Z). Each dipole receives all three transmit signal sub-groups but different dipole polarisations are associated with different sub-group phase shifts. The six port hybrid 410 combines the signals from the transmit signal sub-groups so that the dipoles of the antenna stack AS[3] are driven by combined signals. In operation, the antenna stack AS[3] simulates a virtual antenna stack with polarisations which may differ from those of its dipoles e.g. AS(X).

The relative amplitudes K1, K2 and K3 determine planes for three virtual antennas (not necessarily of dipoles) simulated by the system 400, and hence also directions for three radiation beams which are output from the antenna stack AS[3] in response to signals from the first, second and third corporate feeds CF(X), CF(Y) and CF(Z): each of these directions may and normally will be different to a beam direction for dipoles AS(X) etc of any one polarisation which would arise in the absence of dipoles AS(Y) and AS(Z) etc of the other two polarisations.

The three output radiation beams transmitted from the antenna stack AS[3] have polarisations determined by the relative phases of the signals combined and supplied via respective corporate feeds CF(X), CF(Y) and CF(Z). In the present embodiment, with K1=K2=K3 and the phase shifts tabulated above, the six port hybrid 410 gives rise to three lines or sets of virtual antenna elements, elements in each such line being like-polarised and oriented at 45 degrees to a respective actual line of like-polarised dipoles e.g. AS(X), AS(Y) or AS(Z) etc. Each virtual antenna element therefore provides 45 degree slant polarisation: these elements may be but are not necessarily dipoles since other antenna elements may be simulated, and other phase relationships may give circular or elliptical polarisation as previously described.

Figure 7:
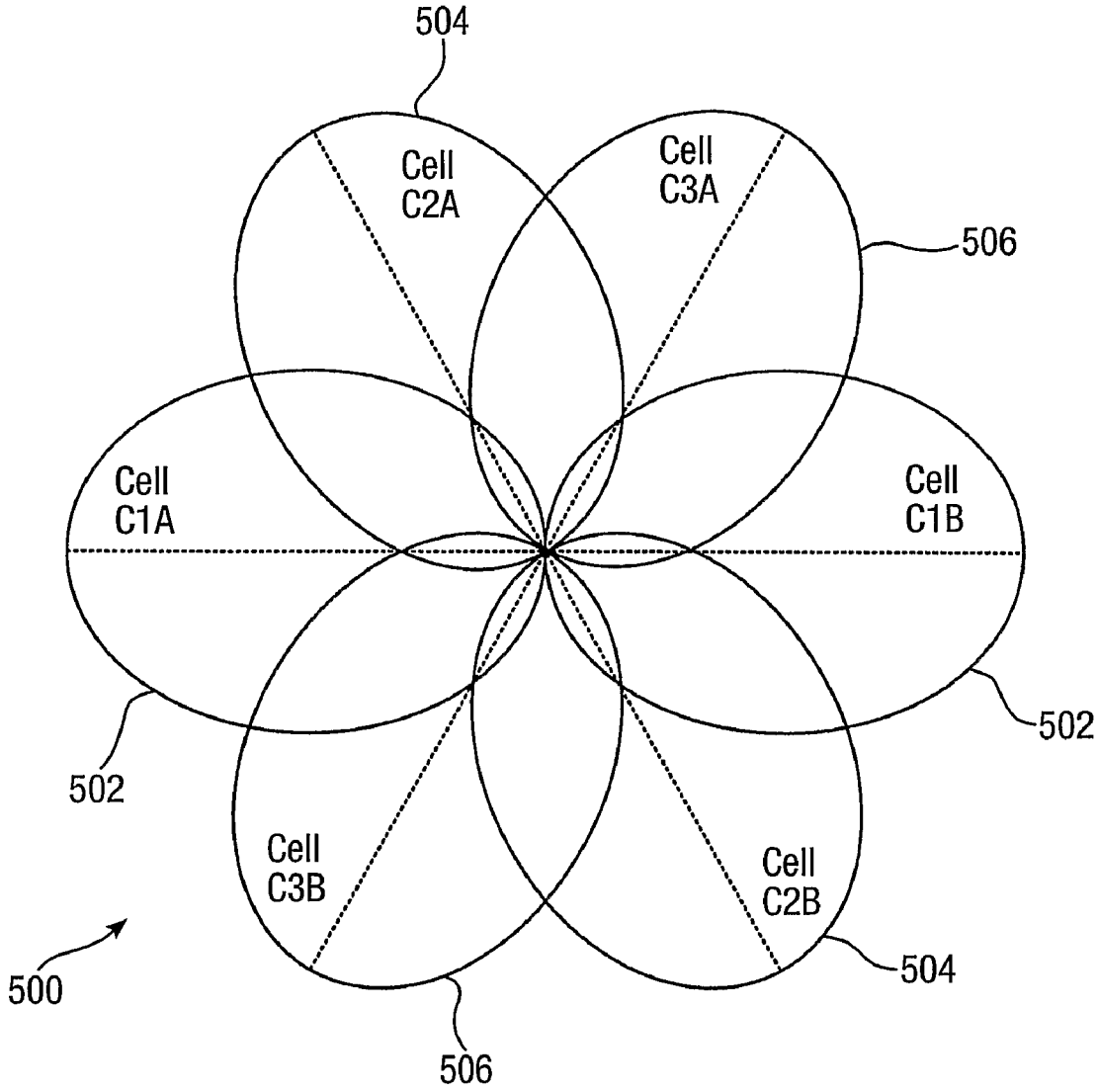
FIG. 7 is a horizontal radiation pattern of the FIG. 6 embodiment.

Referring now also to FIG. 7, there is shown a horizontal radiation pattern indicated generally by 500 for the antenna system 400 with K1=K2=K3 and phase shifts as tabulated above. The antenna system 400 generates three two-lobed radiation patterns 502, 504 or 506 with dotted centre lines, each lobe extending in the opposite direction to that of the other lobe in its pattern. The patterns 502 to 506 determine the coverage of mobile telephone cells served by the antenna stack AS[3]. Pattern 502 provides cells C1A and C1B, pattern 504 cells C2A and C2B, and pattern 506 cells C3A and C3B. The effects produced by signal combining in the six port hybrid 410 and subsequent radiation from the antenna stack AS[3] is that:

a) the first signal sub-group SG1 radiates into cells C1A and C1B with +45 degree slant polarisation, b) the second signal sub-group SG2 radiates into cells C2A and C2B with +45 degree slant polarisation, and c) the third signal sub-group radiates into cells C3A and C3B with +45 degree slant polarisation.

Figure 8:
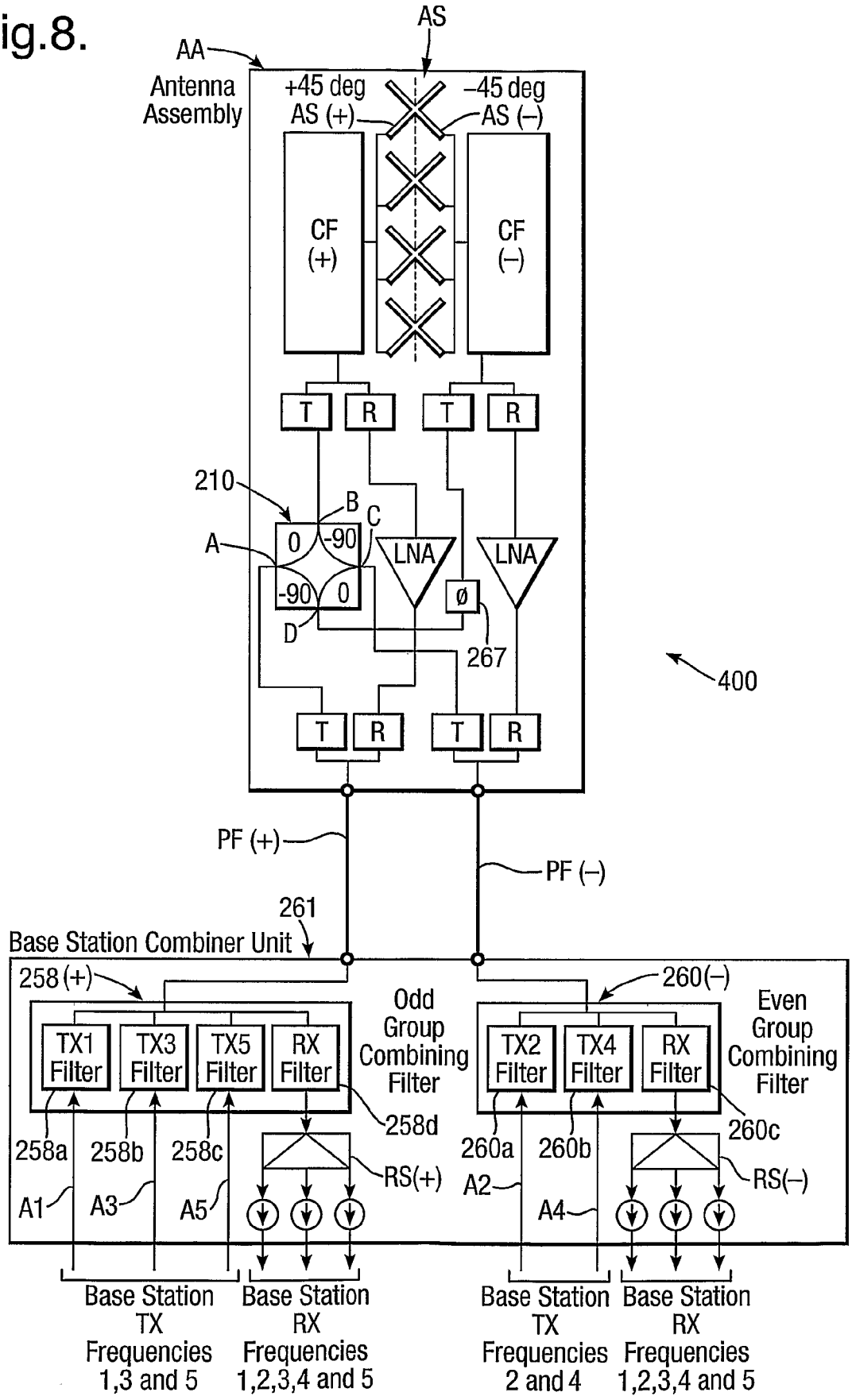
FIG. 8 is a schematic drawing of a further embodiment of the invention providing for transmit signal polarisation to be programmable by selecting a value for a signal delay.

FIG. 8 shows a further embodiment 400 of an antenna system of the invention configured to radiate with a transmit signal polarisation which is programmable by selecting a value for a signal delay. It is equivalent to the earlier embodiment 200 described with reference to FIG. 5 with the addition of a delay device 267. Parts equivalent to those described with reference to FIG. 2 are like referenced and will not be described further. The delay device 267 applies a delay or phase shift $\phi$ to signals passing between hybrid port D and negative polarisation corporate feed CF(−) in either direction. Consequently, and referring also to FIG. 4 once more, any desired delay or phase shift can be obtained between signals fed to different corporate feeds CF(+) and CF(−) by selecting an appropriate value of $\phi$. A delay or phase shift $\phi$ in the opposite sense may be obtained by inserting the delay device 267 between hybrid port B and positive polarisation corporate feed CF(+) instead of in its position shown in FIG. 8.

Various embodiments of the invention make the following possible:

a) operators of antenna systems having orthogonal frequency assignments may have their signals combined without incurring 50% or more power loss associated with use of one or more 3 dB hybrid combiners as in some prior art systems;

b) a variety of antenna polarisations may be obtained by changing the delay between signals fed to orthogonal antenna ports, and different polarisations may be obtained in transmit and receive modes;

c) amplitude weighting of signals provides control of orientation of polarisation for two-dimensional arrays of antenna elements, and both control of orientation of polarisation and control of antenna beam direction for three dimensional arrays of antenna elements;

d) dipole or patch antenna elements may be used;

e) retrofit to an existing antenna design with modest additional cost;

f) location of items implementing the invention either within an antenna assembly, i.e. near to an antenna stack, or alternatively location with base station equipment; and g) alleviation of the "Near-Far" problem: this problem arises with separately located antennas receiving signals from the same source such as a mobile radio handset. if the source is located further from one antenna than from the other, and communicates with the further antenna, it may require sufficiently high power to do so to produce interference with or jamming of the nearer antenna's base station receiving equipment. Antenna sharing facilitated by the invention avoids this, at least as regards signals received by a shared antenna; this is because a shared antenna is equivalent to multiple separate but positionally coincident antennas which are equidistant from a source and therefore are affected equally by signals from that source; i.e. assuming like antennas, polarisations and base station receiving equipment, one coincident antenna will not be jammed by a signal which is received at normal strength by another such antenna.

The invention claimed is:

1. An antenna system for sharing of operation having:

a) means for dividing a set of transmit signals having contiguous frequencies into signal sub-groups having non-contiguous frequencies, b) at least two antennas for radiating transmit signals in respective sub-groups, the antennas also being responsive to received signals and having mutually orthogonal ports, c) coupling apparatus for producing combined signals comprising at least one of combined transmit signals and combined received signals, the coupling apparatus being arranged to:

i) provide isolation between pre-combined signals, and ii) prearrange polarisation for combined signals by introduction of relative delay between signals associated with different antennas.

2. An antenna system according to claim 1 wherein the coupling apparatus is arranged to provide isolation and relative delay between transmit signal sub-groups passing to different antennas in order to prearrange polarisation for signal transmission from the antennas.

3. An antenna system according to claim 1 wherein the coupling apparatus is for providing isolation and relative delay between received signals received by different antennas in order to prearrange polarisation corresponding to maximum sensitivity of signal reception by the antennas.

4. An antenna system according to claim 1 wherein the coupling apparatus is for providing isolation and relative delay both between transmit signal sub-groups passing to different antennas and between received signals received by different antennas in order to prearrange both polarisation for signal transmission from the antennas and polarisation corresponding to maximum sensitivity of signal reception by the antennas.

5. An antenna system according to claim 4 wherein the coupling apparatus is a quadrature hybrid.

6. An antenna system according to claim 4 wherein the coupling apparatus is for routing each transmit signal sub-group to all antennas so that such sub-group becomes radiated from different antennas with relative delay.

7. An antenna system according to claim 1 wherein the coupling apparatus is a hybrid coupling device for prearranging circular or elliptical signal polarisation.

8. An antenna system according to claim 1 wherein the coupling apparatus is for weighting signals differently in amplitude in order to obtain prearranged polarisation directionality different to that corresponding to signals with like amplitude weighting.

9. An antenna system according to claim 1 wherein the at least two antennas are three antennas and the coupling apparatus is a hybrid coupling device arranged to combine signals with a plurality of relative delays.

10. An antenna system according to claim 9 wherein the coupling apparatus is for weighting signals differently in amplitude using three amplitude weighting factors in order to obtain prearranged polarisation directionality different to that corresponding to signals with like amplitude weighting.

11. An antenna system according to claim 1 wherein the at least two antennas each have multiple antenna elements.

12. An antenna system according to claim 1 wherein the coupling apparatus is located within an antenna assembly containing the at least two antennas.

13. An antenna system according to claim 1 wherein the at least two antennas are incorporated in an antenna assembly mounted at a mast head with the coupling means, which itself is located externally of the antenna assembly.

14. An antenna system according to claim 1 wherein the coupling apparatus is co-located with or located near a transmit signal sub-group combiner associated with a base station.

15. An antenna system according to claim 1 wherein the coupling apparatus is a 180 degree hybrid.

16. A method for sharing of operation of an antenna system between multiple operators using a set of transmit signals having contiguous frequencies, the method having the steps of:

a) dividing the set of transmit signals into signal sub-groups having non-contiguous frequencies, b) providing at least two antennas for radiating transmit signals in respective sub-groups, the antennas also being responsive to received signals and having mutually orthogonal ports, c) producing combined signals comprising at least one of combined transmit signals and combined received signals, d) providing isolation between pre-combined signals, and e) introducing relative delay between signals associated with different antennas in order to prearrange polarisation for combined signals.

17. A method according to claim 16 wherein the steps of providing isolation and introducing relative delay are applied to transmit signal sub-groups passing to different antennas in order to prearrange polarisation for signal transmission from the antennas.

18. A method according to claim 16 wherein the steps of providing isolation and introducing relative delay are applied to received signals received by different antennas in order to prearrange polarisation corresponding to maximum sensitivity of signal reception by the antennas.

19. A method according to claim 16 wherein the steps of providing isolation and introducing relative delay are applied both to transmit signal sub-groups passing to different antennas and to received signals received by different antennas in order to prearrange both polarisation for signal transmission from the antennas and polarisation corresponding to maximum sensitivity of signal reception by the antennas.

20. A method according to claim 19 including the step of supplying each transmit signal sub-group to all antennas so that such sub-group becomes radiated from different antennas with relative delay.

21. A method according to claim 19 wherein the steps of producing combined signals, providing isolation and introducing relative delay are implemented using coupling apparatus comprising a quadrature hybrid.

22. A method according to claim 16 wherein the step of introducing relative delay prearranges circular or elliptical signal polarisation.

23. A method according to claim 16 including the step of weighting signals differently in amplitude in order to obtain prearranged polarisation directionality different to that corresponding to signals with like amplitude weighting.

24. A method according to claim 16 wherein the at least two antennas are three antennas and the step of introducing relative delay introduces a plurality of relative delays.

25. A method according to claim 24 including the step of weighting signals differently in amplitude using three amplitude weighting factors in order to obtain prearranged polarisation directionality different to that corresponding to signals with like amplitude weighting.

26. A method according to claim 16 wherein the at least two antennas each have multiple antenna elements.

27. A method according to claim 16 wherein the steps of producing combined signals, providing isolation and introducing relative delay are implemented using coupling apparatus located within an antenna assembly containing the at least two antennas.

28. A method according to claim 16 wherein the at least two antennas are incorporated in an antenna assembly mounted at a mast head and the steps of producing combined signals, providing isolation and introducing relative delay are implemented using coupling apparatus located externally of the antenna assembly.

29. A method according to claim 16 wherein the steps of producing combined signals, providing isolation and introducing relative delay are implemented using coupling apparatus co-located with or located near a transmit signal sub-group combiner associated with a base station.

30. A method according to claim 16 wherein the steps of producing combined signals, providing isolation and introducing relative delay are implemented using coupling apparatus comprising a 180 degree hybrid.

* * * * *